United States Patent [19]

Porter

[11] Patent Number: 4,505,038

[45] Date of Patent: Mar. 19, 1985

[54] COMPOUND LEVER TOOLS FROM SHEET METAL

[75] Inventor: Thomas M. Porter, Concord, Mass.

[73] Assignee: H.K. Porter, Inc., Somerville, Mass.

[21] Appl. No.: 554,087

[22] Filed: Nov. 21, 1983

[51] Int. Cl.[3] ..... B26B 17/02
[52] U.S. Cl. ..... 30/193
[58] Field of Search ..... 30/190, 191, 192, 193, 30/250

[56] References Cited

U.S. PATENT DOCUMENTS

| | | | |
|---|---|---|---|
| 914,910 | 3/1909 | Alley | 30/191 |
| 2,527,496 | 10/1950 | Geddes | 30/193 |
| 2,685,130 | 8/1954 | Tibbetts | 30/193 |
| 2,910,900 | 11/1959 | Klein | 30/193 |
| 3,074,164 | 1/1963 | Porter | 30/193 |
| 3,574,938 | 4/1971 | Porter | 30/193 |

FOREIGN PATENT DOCUMENTS

| | | | |
|---|---|---|---|
| 506291 | 5/1920 | France | 30/193 |

*Primary Examiner*—Jimmy C. Peters
*Attorney, Agent, or Firm*—Henry C. Nields

[57] ABSTRACT

A compound lever tool having a pair of interpivoted head levers with jaws and a toggle mechanism consisting of two actuating levers connected to each other by a toggle pivot and each connected to its respective head lever by a head pivot such that movement of the actuating levers towards each other spreads the rearward ends of the head levers apart and causes the jaws to close, the actuating levers each formed from sheet metal and bent to provide an upper and lower surface with each surface having aligned holes adapted to receive the toggle pivot and its respective head pivot. In the preferred embodiment the actuating levers are cloven to separate head pivot-supporting parts from the toggle pivot-supporting parts and adjustable blocks are disposed within the clefts to provide lateral support between the toggle pivot and the respective head pivots.

7 Claims, 10 Drawing Figures

COMPOUND LEVER TOOLS FROM SHEET METAL

BACKGROUND OF THE INVENTION

This invention relates to compound lever tools and, in particular, to compound lever tools in which the toggle mechanism is formed from sheet metal.

Various tools are known that employ multiple levers. Examples of early compound lever, cutting and crimping tools are disclosed in U.S. Pat. Nos. 146,829 and 147,850. A compound lever machine is one in which a train of levers are employed whereby force is transmitted from the arm of one lever to that of the next lever. One particular type of compound lever machine, which is particularly useful in amplifying forces for cutting and crimping, also employs a toggle joint to connect the actuating levers (which are typically integral with the tool handles). The toggle mechanism converts the large sweep of the handles into a shorter, more powerful clench at the jaws.

A problem with compound lever, toggled-jointed, tools is that over periods of use the actuating levers are deformed by the force of the toggle mechanism. When this happens the "action" becomes loose, making it difficult to part or shear smaller or harder objects. Traditionally, manufacturers of tools employing these mechanisms have resorted to massive, forged or cast actuating levers which can withstand deformation for reasonably long periods of time. However, most of these tools also have employed an adjustment to compensate for wear over long-term use. Examples of adjustable, compound lever tools can be found in U.S. Pat. Nos. 226,190, 2,527,496, 2,910,900, and 3,074,164.

Despite the cost, most manufacturers of compound lever tools have continued to rely upon forged steel or cast iron parts to form their actuating levers. Sheet metal stamped levers have replaced forged or cast parts only on tools which are not intended for long-term or heavy-duty use. Apparently, two reasons for this reluctance on the part of manufacturers are the perceived weakness of stamped parts and the inability to adjust sheet metal tools for wear.

The difficulty in adapting a sheet metal part to include a wear-adjusting mechanism resides in need to secure a lateral support between the toggle points. Typically, the adjustment mechanism in compound lever tools includes a screw which is threaded through the actuating lever and tightened over time. Because stamped parts are formed from thin sheets of metal, the strength of the adjustment mechanism and the range over which it can be adjusted are limited by the number of threads that can be formed within a hole in the sheet.

There exists a need for simpler, less expensive, adjustable cutting tools, for clipping metal bolts, bailing wire, sheet metal, as well as swaging or crimping ferrules, rings, clamps and the like. A compound lever, toggle-actuated cutting tool would satisfy a long-felt need in the industry, if it could be fabricated without resort to forged or cast actuating levers.

SUMMARY OF THE INVENTION

It has been discovered that a simple, economical cutting tool can be manufactured having adjustable, actuating levers formed from sheet metal. According to the invention a toggle mechanism is fabricated from two sheet metal actuating levers, each of the metal sheets being cut and bent to provide an upper and lower surface, with each surface carrying holes which are aligned to receive a toggle pivot (to connect the actuating levers together) and a head pivot (to connect each actuating lever to its respective, jaw-carrying, head lever).

In another aspect the sheet metal actuating levers are cloven to separate the head pivot-supporting parts from the toggle pivot-supporting parts and adjustable blocks are disposed within the clefts to provide lateral support between toggle pivot and the respective head pivots. The sheet metal levers are also bent to form a rearward eyelet that receives a threaded portion of the block. The adjustable block then can be secured by a nut or the like on the other side of the eyelet. By employing a crimped eyelet, rather than attempting to form a threaded hole in the sheet metal itself, the invention overcomes a substantial problem which has faced manufacturers in the past.

Moreover, in the present invention the sheet metal levers can be stamped by a simple series of dies at far less expense than the machining of a comparable forged lever. Additionally, the stamped levers of the present invention can be heat treated for improved hardness and durability.

The invention will next be described in connection with certain preferred embodiments; however, it should be clear that various changes and modifications can be made by those skilled in the art without departing from the spirit or scope of the invention as claimed. For example, various means may be used interchangeably for fastening together the components of the tools: bolts and nuts, pins, rivets, etc. The jaws may carry blades for clipping objects or may carry gripping surfaces to grab a workpiece. The tool itself, may be manually operated or pneumatically driven or otherwise power-assisted. While the tool is shown in the illustrations below with substantially symmetrical right and left levers, one or the other lever may be modified, for example, by omitting the cleft and adjustable block from the lever. Additionally, various other structures can be designed to form a rearward surface on the actuating lever to receive the stem of the adjustable block. The size of the levers and the type of sheet metal used will vary with the forces to be exerted and the particular applications expected.

DESCRIPTION OF THE PREFERRED EMBODIMENTS

Figures 1, 1A:
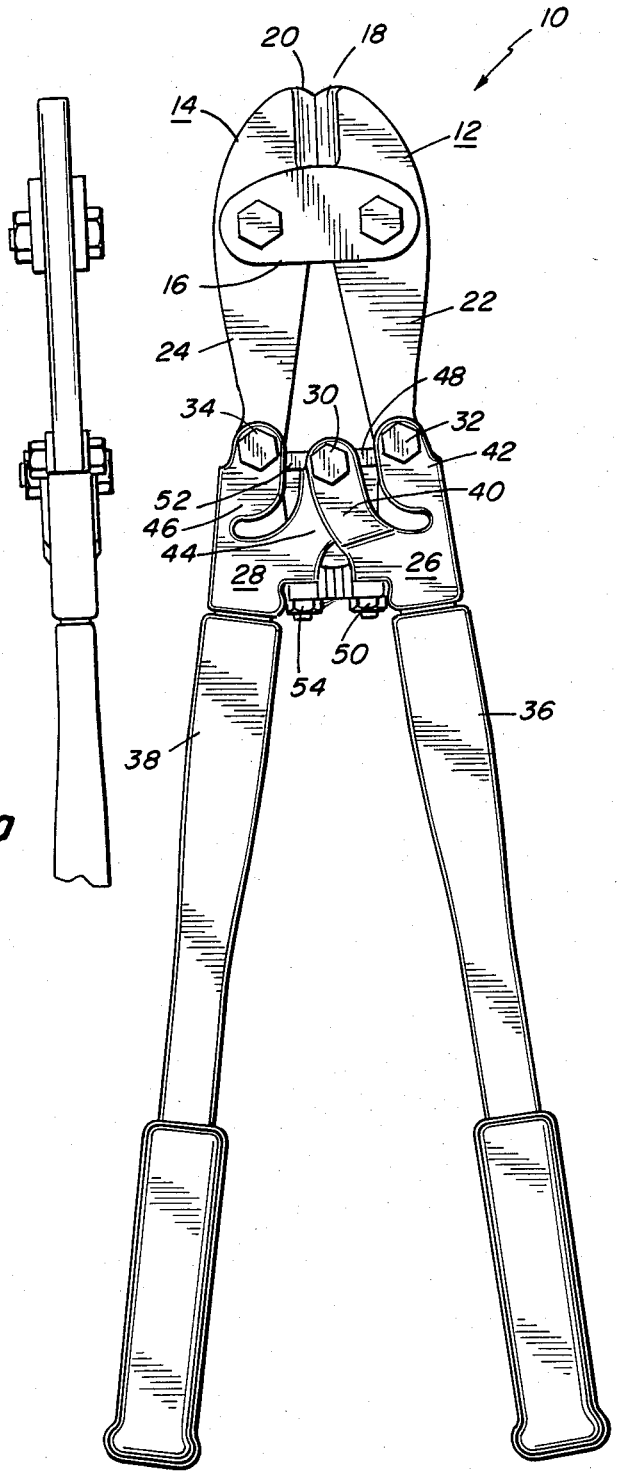
FIG. 1 is a top plan view of a cutting tool according to the invention.
FIG. 1*a* is a partial side view of the same tool.

In FIG. 1 and FIG. 1*a* the tool 10 is shown comprising right head lever 12 and left head lever 14 interpivoted at intermediate points on plate 16. Each head lever 12, 14, respectively, has a jaw portion 18, 20 and a tail portion 22, 24.

Right actuating lever 26 overlaps left actuating lever 28 and is connected thereto by toggle pivot bolt 30. The actuating levers 26, 28 are connected to the tails of their respective head levers 22, 24 by head pivot bolts 32 and 34, respectively. At their rearward ends, the actuating levers 26 and 28 are connected to handles 36 and 38, respectively. Right actuating lever 26 is cleft to form toggle pivot-supporting part 40 and a head pivot-supporting part 42. Similarly, left actuating lever 28 comprises a toggle pivot-supporting part 44 and a head pivot-supporting part 46.

Disposed within the cleft of right lever 26 is a block 48 adjustable by nut 50. Likewise, disposed within the cleft of left lever 28 is a block 52 adjustable by nut 54.

In FIGS. 2, 2*a*, 2*b* and 2*c*, the sheet metal construction of right actuating lever 26 is shown in detail. The left actuating lever 28 can be identical, with the bend along line 56 on each lever permitting the levers 26 and 28 to be interveaven so that such lever overlaps the other at the toggle pivot hole 58. Alternatively, either lever can be constructed to overlap the other completely by employing a bend on each of the upper and lower surfaces of such lever while the other lever is not bent at either surface. In this alternative embodiment the unbent lever is inserted within the lever which is spread by the bends and then the holes are aligned in the same manner.

Figure 2B:
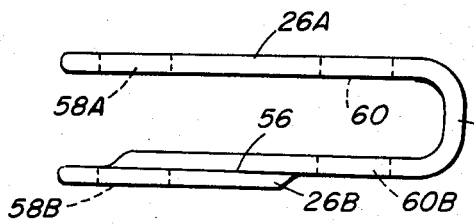
FIG. 2*b* is a front view.
Figure 2:
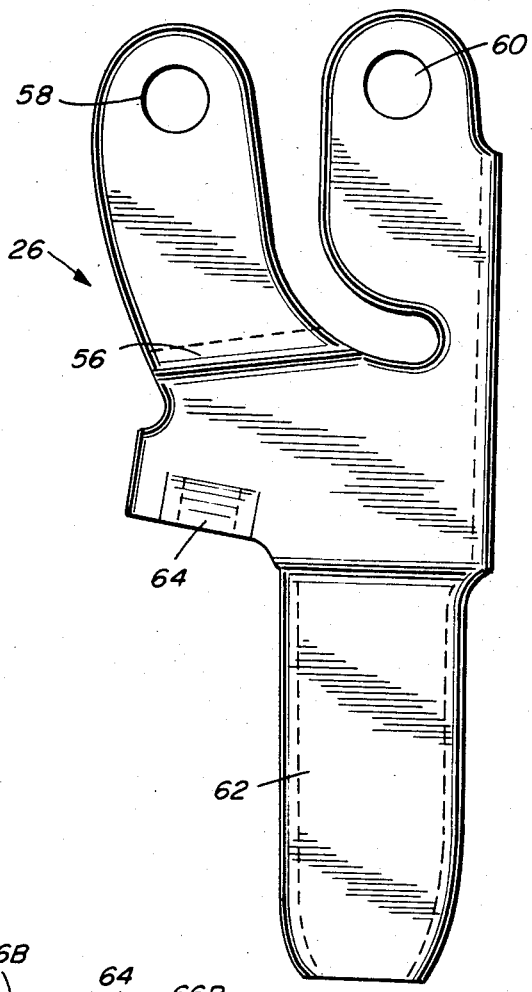
FIG. 2 is a top plan view of the right actuating lever of the tool of FIG. 1.
Figure 2A:
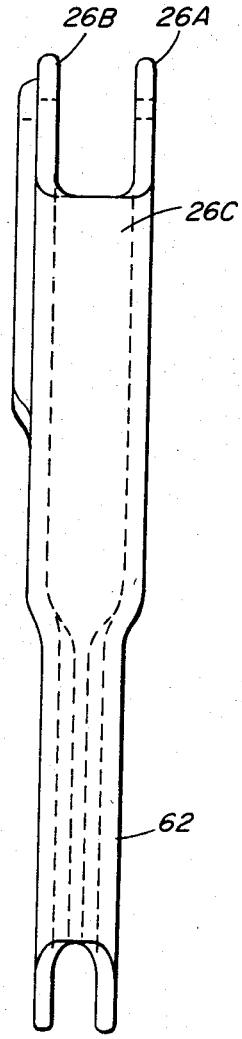
FIG. 2*a* is a side view.
Figure 3A:
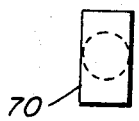
FIG. 3*a* is a top view of the wedge and stem portion.
Figure 3B:
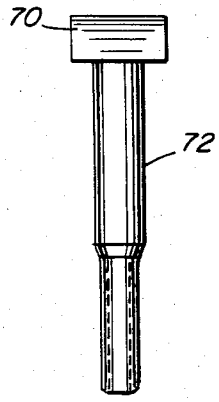
FIG. 3*b* is a side view of the wedge and stem portion.
Figure 3C:
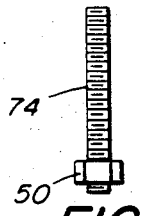
FIG. 3*c* is a side view of the threaded portion, respectively, of the same adjustable block.
Figure 2C:
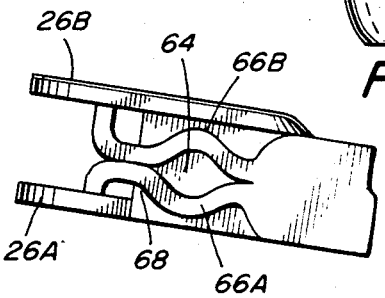
FIG. 2*c* is a partial rear view, respectively, of the same lever.
Figure 3:
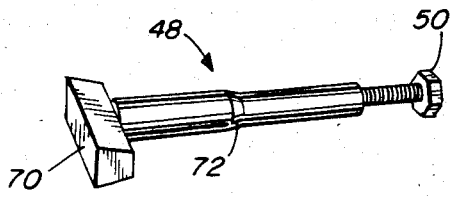
FIG. 3 is an isometric view of one of the adjustable blocks of FIG. 1.

As can be seen from FIGS. 2*a* and 2*b*, lever 26 is formed from sheet metal and bent to yield an upper surface 26A and a lower surface 26B. Through these surfaces 26A and 26B are aligned the toggle pivot holes 58A and 58B as well as the head pivot holes 60A and 60B. The upper and lower surfaces 26A and 26B are connected at the bent surface 26C. The rearward portion of the lever 26 is crimped to yield a handle insert portion 62 and an eyelet 64 for the adjustable block 48 (see FIG. 1). With reference to FIG. 2*c* the construction of the rearward eyelet 64 is shown in more detail comprising crimped upper surface 66A and crimped lower surface 66B.

In manufacturing the sheet metal levers may be stamped by a short series of sequential separations. For example, in a first die press, a blank can be cut. In a second step the rounded shape of the handle insert 62, the two sides of the eyelet 64 and the bend 56 can be formed. In a third step the holes can be pierced and in a final step the part is bent into a "U" shape to create the upper and lower surfaces, 26A and 26B. For continuous manufacturing a progressive die, encompassing each of these steps, can be employed.

Once the stamped lever is fully formed it is preferred to heat treat it by conventional procedures to maximize its hardness. This can be accomplished in a typical procedure by heating the part to about 1500° F and then quenching it in oil, followed by reheating to 800° F to temper.

In FIGS. 3, 3*a*, 3*b* and 3*c*, the right adjustable block 48 and nut 50 are shown in more detail. The block 48 comprises a wedge portion 70, a stem portion 72 and a threaded shaft 74. Alternatively, the threaded shaft 74 and nut 50 may be replaced by a bolt (not shown) or various other means to adjust the position of the wedge 70 within the cleft as shown in FIG. 1. Again, the left adjustable block 52 can be substantially identical.

To produce a block with sufficient hardness to function effectively over the lifetime of the tool, providing lateral support in the cleft, it is preferable to harden at least the top or wedge portion 70 of the block 48. This can be accomplished by heat treatment similar to that used to harden the stamped lever, as hereinbefore described. The shaping of the block is accomplished by "cold-heading" the block, that is, fabricating the wedge from a steel rod by pounding until the desired shape is obtained.

In operation, screwing in nuts 50 and 54 draws blocks 48 and 52 into the clefts of levers 26 and 28, respectively, to provide lateral support and adjustment for the toggle mechanism. As handles 36 and 38 are closed, the head bolts 32, 34 and the toggle bolt 30 approach lateral alignment, whereby a maximum outward force is exerted upon the tails 22, and 24 of head levers 12 and 14 causing the jaws 18 and 20 to clench tightly.

What is claimed is:

1. An improved, compound lever tool, having a pair of interpivoted head levers with jaws at their forward ends and tails at their rearward ends; and a toggle mechanism comprising two actuating levers pivoted together, the actuating levers having forward ends connected to the tails of the head levers and rearward ends adapted to receive handle arms to which force may be applied, the improvement wherein:

the toggle mechanism further comprises at least one actuating lever formed from a metal sheet, each sheet being bent to provide an upper and a lower surface; and each surface carrying holes which are aligned to receive a toggle pivot rod to connect the actuating levers together and to receive a head pivot rod to connect the actuating lever to the tail of its respective head lever; and at least one sheet metal-formed actuating lever is cloven inwardly to separate a toggle pivot-supporting part from a head pivot-supporting part, and the toggle mechanism further comprises at least one block received within the cleft of the sheet metal-formed actuating lever, the block being adjustable lengthwise between forward and rearward positions in the cleft to provide varying amounts of lateral support between the pivots in operation.

2. The tool of claim 1 wherein the sheet metal actuating lever further comprises a lever formed from heat-treated sheet metal.

3. The tool of claim 1 wherein the block further comprises a stem portion extending rearward and a threaded rear end and the sheet metal-formed actuating lever further comprises a rearward bent surface formed from the same metal sheet, the rearward bent surface carrying a hole adapted to receive the stem of the block, and the tool further comprises a securing means for securing the threaded stem and block to the sheet metal-formed lever.

4. The tool of claim 3 wherein the rearward bent surface of the sheet metal actuating level is manufactured by pressing portions of the upper and lower surface together to form a hole to receive the stem.

5. The tool of claim 3 wherein the block further comprises a block having a wedge-shaped top to provide varying amounts of lateral support.

6. The tool of claim 3 wherein the block further comprises a block formed from cold-headed steel.

7. The tool of claim 1 wherein both actuating levers are formed from sheet metal.

* * * * *